US008410385B2

(12) United States Patent
Dai

(10) Patent No.: US 8,410,385 B2
(45) **Date of Patent: *Apr. 2, 2013**

(54) KEYPAD ASSEMBLY AND ELECTRONIC DEVICE USING THE SAME

(75) Inventor: Bin Dai, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 285 days.

This patent is subject to a terminal disclaimer.

(21) Appl. No.: 12/915,277

(22) Filed: Oct. 29, 2010

(65) Prior Publication Data

US 2012/0061221 A1 Mar. 15, 2012

(30) Foreign Application Priority Data

Sep. 10, 2010 (CN) ..... 2010 1 0278415

(51) Int. Cl.
*H01H 13/14* (2006.01)

(52) U.S. Cl. ..... 200/344; 200/296; 200/341; 200/343

(58) Field of Classification Search ..... 200/5 A, 200/341–345, 296; 400/490–496; 341/22; 345/168, 169

See application file for complete search history.

(56) References Cited

U.S. PATENT DOCUMENTS

| | | | | |
|---|---|---|---|---|
| 5,901,837 | A * | 5/1999 | Aimi | 200/344 |
| 6,100,482 | A * | 8/2000 | Koma et al. | 200/344 |
| 6,960,734 | B1 * | 11/2005 | Park | 200/343 |
| 7,126,071 | B1 * | 10/2006 | Yang et al. | 200/344 |
| 7,265,310 | B1 * | 9/2007 | Wang | 200/344 |
| 2004/0118665 | A1 * | 6/2004 | Ito | 200/5 A |
| 2006/0113175 | A1 * | 6/2006 | Uchizono et al. | 200/341 |
| 2009/0260970 | A1 * | 10/2009 | Tsai et al. | 200/5 A |
| 2010/0089736 | A1 * | 4/2010 | Tsai et al. | 200/5 A |

* cited by examiner

*Primary Examiner* — Michael Friedhofer
(74) *Attorney, Agent, or Firm* — Altis Law Group, Inc.

(57) ABSTRACT

A keypad assembly includes a support member, a key switch, a keycap, and a resilient member. The key switch is fixed on the support member and includes a triggering portion. The keycap is located opposite to the triggering portion. The resilient member includes a rotation portion and a resilient support portion connected to the rotation portion. The rotation portion is rotatably connected to the keycap and the support member. The resilient support portion is elastically deformed via resisting the support member when the key switch is not triggered, and provides an elastic restoring force to the rotation portion.

18 Claims, 4 Drawing Sheets

KEYPAD ASSEMBLY AND ELECTRONIC DEVICE USING THE SAME

CROSS-REFERENCE TO RELATED APPLICATIONS

This application is related to four co-pending U.S. patent application Ser. Nos. 12/913,006, 12/913,016, 12/915,280, 12/915,284, all entitled "KEYPAD ASSEMBLY AND ELECTRONIC DEVICE USING THE SAME", and the inventor is Bin Dai. Such applications have the same assignee as the instant application and are concurrently filed herewith. The disclosures of the above-identified applications are incorporated herein by reference.

BACKGROUND

1. Technical Field

The present disclosure relates to data input, and particularly, to a keypad assembly used in an electronic device.

2. Description of the Related Art

Electronic devices often provide a keypad on a panel thereof, thus allowing control input for a power source or other component to be entered by the user.

A keypad assembly is located on a housing of an electronic device. The housing defines a mounting port in a rear surface of the housing. The keypad assembly includes a keycap and a key switch. The keycap is received in the mounting port, and includes a protrusion arranged at a bottom of the keycap. The key switch includes a triggering portion and a contact point. The triggering portion is a convex resilient sheet. The protrusion resists a top of the triggering portion. When the keycap is depressed, the triggering portion is elastically deformed and electrically connects to the contact point. When the keycap is released, the triggering portion returns to its relaxed state. However, a clearance can occur between the protrusion and the triggering portion, due to manufacturing tolerance or assembly error. The keycap slides in the mounting port without any resistance because of the clearance, such that the contact response of the keypad assembly is lowered.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
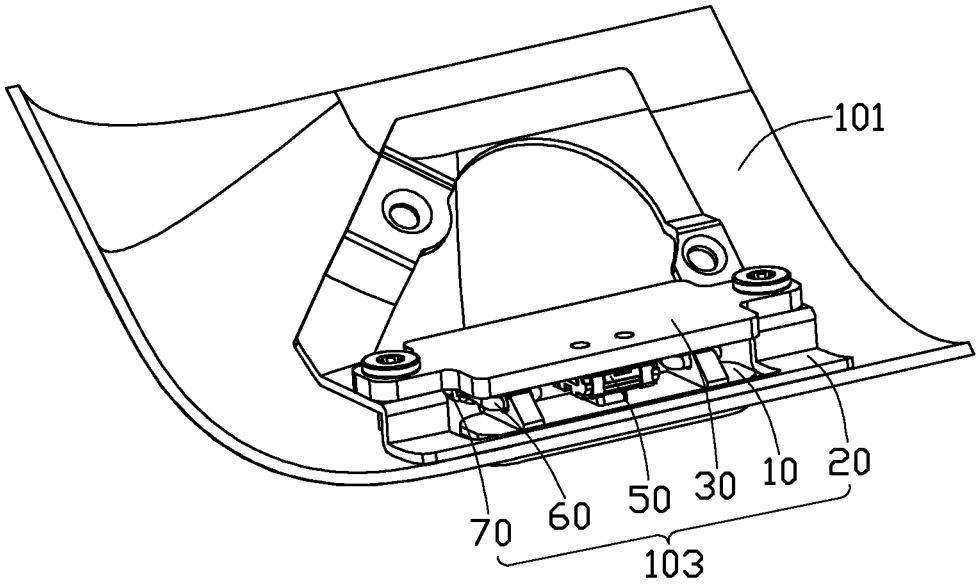
FIG. 1 is a partial, assembled, isometric view of one embodiment of an electronic device, the electronic device including a housing and a keypad assembly mounted on the housing.
Figure 2:
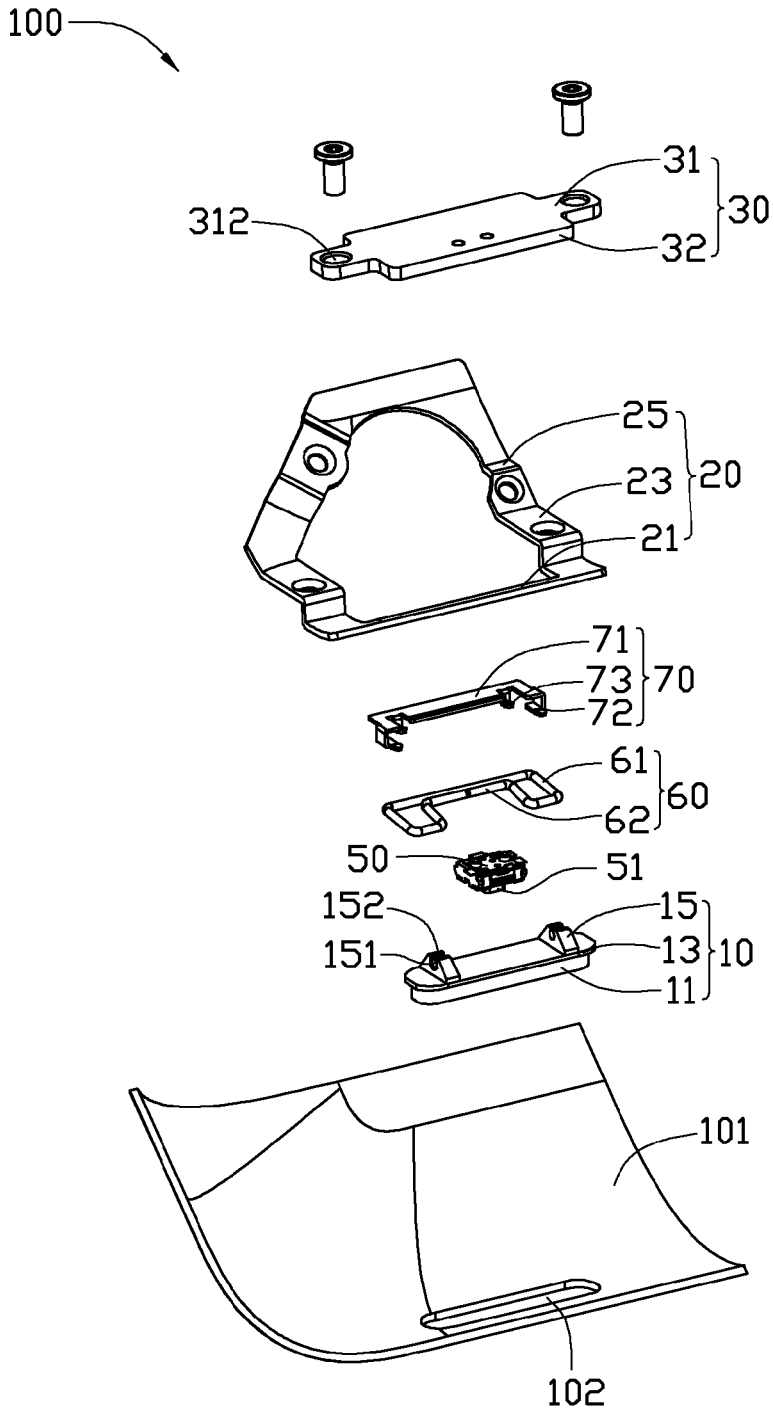
FIG. 2 is an exploded, isometric view of the electronic device shown in FIG. 1.

Referring to FIGS. 1 and 2, an embodiment of an electronic device 100 includes a housing 101 and a keypad assembly 103 located on the housing 101. In the illustrated embodiment, the keypad assembly 103 is a menu button and the housing 101 is an outer case of the electronic device 100. The housing 101 defines a mounting port 102 in the housing 101. In the illustrated embodiment, the mounting port 102 is a through hole.

The keypad assembly 103 includes a keycap 10, a fixing bracket 20, a support member 30, a key switch 50, a resilient member 60, and a fixing member 70. The keycap 10 is partially received in the mounting port 102. The fixing bracket 20 is fixed on an inner surface of the housing 101 adjacent to the mounting port 102. The support member 30 is fixed to the fixing bracket 20 and located opposite to the mounting port 102. The key switch 50 is fixed on the support member 30. The resilient member 60 rotatably interconnects the keycap 10 and the fixing member 70. The fixing member 70 is fixed to the support member 30.

The keycap 10 includes a contact portion 11, a limiting portion 13 and two connecting portions 15. The contact portion 11 is substantially oblong and slidably received in the mounting port 102. The limiting portion 13 is arranged at a side of the contact portion 11. The limiting portion 13 is larger than the mounting port 102, such that the contact portion 11 is retained within the mounting port 102. The two connecting portions 15 are located at opposite ends of an outer surface of the limiting portion 13. In the illustrated embodiment, each connecting portion 15 defines a pivotal hole 151 in the center of the corresponding connecting portion 15 and a gap 152 communicating with the pivotal hole 151.

The fixing bracket 20 includes a first fixing portion 21, two second fixing portions 23, and a third fixing portion 25. The first fixing portion 21 is substantially rectangular and fixed in an inner side of the housing 101. The two second fixing portions 23 extend from opposite ends of the first fixing portion 21, and are fixed to opposite ends of the third fixing portion 25. The first fixing portion 21, the second fixing portions 23 and the third fixing portion 25 cooperatively form a substantially closed bracket. In this embodiment, the first fixing portion 21 is fixed on an inner side of the housing 101 by welding. The third fixing portion 25 is used to fix other components (not shown) of the electronic device 100.

The support member 30 includes a main body 31 and a support portion 32 located at the center of one side of the main body 31. The main body 31 defines two through holes 312 in opposite ends of the main body 31. The main body 31 is fixed on the second fixing portion 23 of the fixing bracket 20 via a plurality of threaded fasteners (not shown) received in the through holes 312.

The key switch 50 is fixed on the support portion 32 of the support member 30, and includes a triggering portion 51. The limiting portion 13 of the keycap 10 contacts the triggering portion 51 to trigger the key switch 50. In this embodiment, the key switch 50 is fixed on the support member 30 by welding.

The resilient member 60 includes a rotation portion 61 and a resilient support portion 62. The rotation portion 61 and the resilient support portion 62 are substantially U-shaped, and each having two arms (not labeled). Opposite ends of the rotation portion 61 are connected to opposite ends of the resilient support portion 62, such that the rotation portion 61 and the resilient support portion 62 cooperatively form a looped structure. The rotation portion 61 is larger than the resilient support portion 62. In the illustrated embodiment, the resilient support portion 62 and the rotation portion 61 are not coplanar. The resilient member 60 is of an elastic wire.

The fixing member 70 includes a fixing portion 71, two first hooks 72, and two second hooks 73. The two second hooks 73 are arranged on the fixing portion 71. In another embodiment, the resilient member 60 is made from an elastic material.

Figure 3:
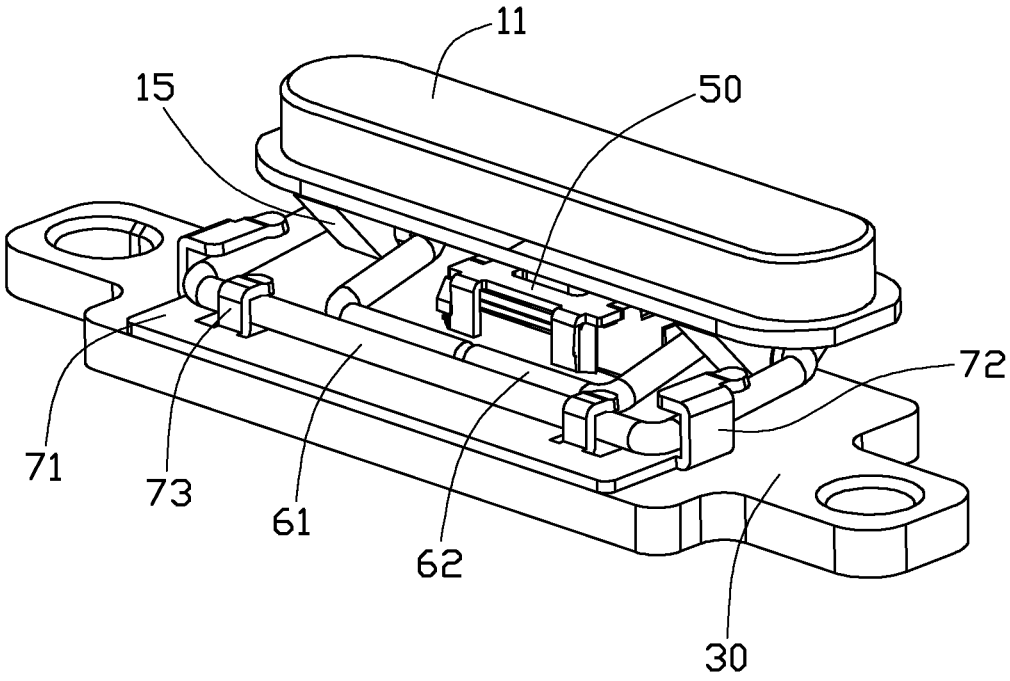
FIG. 3 is an assembled, isometric view of the keypad assembly.
Figure 4:
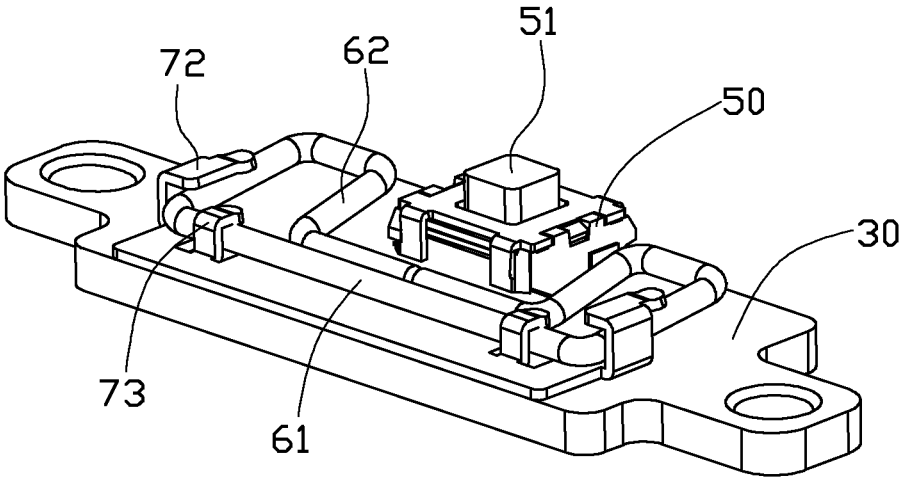
FIG. 4 is a partial, isometric view of the keypad assembly shown in FIG. 3.

Referring to FIGS. 2 and 3, during assembly of the keypad assembly 103, a middle portion of the rotation portion 61 of the resilient member 60 is latched with the second hooks 73 of the fixing member 70. Two of the arms of the resilient member 60 are latched in the first hooks 72 of the resilient member 70. Opposite ends of the rotation portion 61 are received in the pivotal holes 151 of the keycap 10 via the gaps 152, such that the rotation member 60 can be rotated relative to the keycap 10. The first fixing portion 21 of the fixing bracket 20 is fixed on an inner side of the housing 101. The opposite ends of the main body 31 of the support member 30 are connected to the two second fixing portions 23 of the fixing bracket 20. The contact portion 11 of the keycap 10 is received in the mounting port 102 of the housing 101. The key switch 50 is fixed on a side of the support member 30.

When depressed, the keycap 10 slides toward the triggering portion 51 of the key switch 50 until the key switch 50 is triggered. When the keycap 10 is released, the triggering portion 51 of the key switch 50 returns to a relaxed state and resists the keycap 10. The rotation portion 61 of the resilient member 60 rotates relative to the fixing member 70 at an angle, such that the resilient support portion 62 is elastically deformed via resisting the support member 30 and provides an elastic restoring force to the rotation portion 61. Thus, the limiting portion 13 of the keycap 10 tightly contacts the triggering portion 51 of the key switch 50, such that the keypad assembly 103 provides an acceptable resistance.

It should be pointed out that the elastic restoring force of the resilient member 60 is less than the biasing force provided by the keycap 10, so that the key switch 50 is prevented from being triggered inadvertently.

It is to be understood that the fixing bracket 20 can also be omitted, correspondingly, whereby the support member 30 is fixed on an inner side of the housing 101. The fixing member 70 can also be omitted, and the rotation portion 61 of the resilient member 60 is rotatably connected to the support member 30; for example, the support member 30 defines a pivotal hole (not shown), and the rotation portion 61 passes through the pivotal hole.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. A keypad assembly comprising:

a support member;

a key switch fixed on the support member and comprising a triggering portion;

a keycap comprising a limiting portion located opposite to the triggering portion; and a resilient member comprising a rotation portion and a resilient support portion connected to the rotation portion, wherein the rotation portion is rotatably connected to the keycap and the support member; the resilient support portion is elastically deformed via resisting against the support member to make the limiting portion keep resisting against the triggering portion when the key switch is not triggered, and provides an elastic restoring force to the rotation portion.

2. The keypad assembly of claim 1, wherein the keycap further comprises a contact portion, and two connecting portions located at opposite ends of an outer surface of the limiting portion respectively, the limiting portion is arranged at a side of the contact portion, and the rotation portion is rotatably connected to the two connecting portions.

3. The keypad assembly of claim 2, wherein each connecting portion defines a pivotal hole and a gap communicating with the pivotal hole, with opposite ends of the rotation portion received in the pivotal holes via the gaps.

4. The keypad assembly of claim 1, further comprising a fixing bracket fixed to the support member.

5. The keypad assembly of claim 4, wherein the support member comprises a main body and a support portion located at the center of a side of the main body, and the key switch is fixed on the support portion.

6. The keypad assembly of claim 1, wherein the rotation portion and the resilient support portion are substantially U-shaped, opposite ends of the rotation portion are connected to opposite ends of the resilient support portion respectively, such that the rotation portion and the resilient support portion cooperatively form a looped structure.

7. The keypad assembly of claim 1, further comprising a fixing member fixed on the support member, and the fixing member comprising a plurality of hooks latching with the rotation portion.

8. A keypad assembly comprising:

a support member;

a fixing bracket fixed to the support member;

a key switch fixed on the support member and comprising a triggering portion;

a keycap located opposite to the triggering portion; and a resilient member comprising a rotation portion and a resilient support portion connected to the rotation portion, wherein the rotation portion and the resilient support portion are substantially U-shaped, opposite ends of the rotation portion are connected to opposite ends of the resilient support portion respectively, such that the rotation portion and the resilient support portion cooperatively form a looped structure, the rotation portion is rotatably connected to the keycap and the support member, the resilient support portion is capable of elastically deforming, and is elastically deformed the keycap biases the triggering portion.

9. The keypad assembly of claim 8, wherein the keycap further comprises a contact portion, a limiting portion arranged at a side of the contact portion and two connecting portions located at opposite ends of an outer surface of the limiting portion respectively, and the rotation portion is rotatably connected to the two connecting portions.

10. The keypad assembly of claim 9, wherein each connecting portion defines a pivotal hole and a gap communicating with the pivotal hole, with opposite ends of the rotation portion received in the pivotal holes via the gaps.

11. The keypad assembly of claim 8, wherein the support member comprises a main body and a support portion located at the center of a side of the main body, and the key switch is fixed on the support portion.

12. The keypad assembly of claim 8, further comprising a fixing member fixed on the support member, and the fixing member comprising a plurality of hooks latching with the rotation portion.

13. An electronic device comprising:

a housing defining a mounting port;

a keypad assembly located on the housing, the keypad assembly comprising:

a support member fixed to the housing;

a key switch fixed on the support member and comprising a triggering portion;

a keycap comprising a limiting portion located opposite to the triggering portion and partially received in the mounting port; and a resilient member comprising a rotation portion and a resilient support portion connected to the rotation portion, wherein the rotation portion is rotatably connected to the keycap and the support member; the resilient support portion is elastically deformed by resisting the support member to make the limiting portion keep resisting against the triggering portion when the key switch is not triggered, and provides an elastic restoring force to the rotation portion.

14. The electronic device of claim 13, wherein the keycap further comprises a contact portion, and two connecting portions located at opposite ends of an outer surface of the limiting portion respectively, the limiting portion is arranged at a side of the contact portion, wherein the rotation portion is rotatably connected to the two connecting portions.

15. The electronic device of claim 14, wherein each connecting portion defines a pivotal hole and a gap communicating with the pivotal hole, with opposite ends of the rotation portion received in the pivotal holes via the gaps.

16. The electronic device of claim 13, wherein the keypad assembly comprises a fixing bracket fixed to the support member.

17. The electronic device of claim 16, wherein the support member comprises a main body and a support portion located at the center of a side of the main body, and the key switch is fixed on the support portion.

18. The electronic device of claim 13, wherein the rotation portion and the resilient support portion are substantially U-shaped, opposite ends of the rotation portion are connected to opposite ends of the resilient support portion respectively, such that the rotation portion and the resilient support portion cooperatively form a looped structure.

* * * * *